US008479312B2

(12) United States Patent
Dovner et al.

(10) Patent No.: US 8,479,312 B2
(45) Date of Patent: Jul. 9, 2013

(54) PROTECTIVE GARMENTS HAVING QUICK RELEASE SYSTEMS AND ASSOCIATED METHODS

(76) Inventors: Edward R. Dovner, Spindale, NC (US); Gary Lesley, Burnsville, MN (US)

( * ) Notice: Subject to any disclaimer, the term of this patent is extended or adjusted under 35 U.S.C. 154(b) by 1447 days.

(21) Appl. No.: 12/035,924

(22) Filed: Feb. 22, 2008

(65) Prior Publication Data

US 2013/0139287 A1 Jun. 6, 2013

Related U.S. Application Data

(60) Provisional application No. 60/891,065, filed on Feb. 22, 2007.

(51) Int. Cl.
*F41H 1/02* (2006.01)
*F41H 1/04* (2006.01)

(52) U.S. Cl.
USPC ..... 2/2.5

(58) Field of Classification Search
USPC ..... 2/2.5, 102, 108, 94, 96, 462, 464, 2/467; 24/599.4, 599.5, 599.9, 600.9, 601.1, 24/601.5, 606, 600.2
See application file for complete search history.

(56) References Cited

U.S. PATENT DOCUMENTS 158,220 A * 12/1874 Reynolds ..... 24/599.4
577,315 A * 2/1897 Nichols ..... 54/69
4,183,097 A * 1/1980 Mellian ..... 2/2.5
4,545,773 A * 10/1985 Evert ..... 441/114
5,012,964 A * 5/1991 Falletta et al. ..... 224/153
5,950,894 A * 9/1999 Haber ..... 224/627
6,769,137 B2 8/2004 D'annunzio
6,948,188 B2 9/2005 D'annunzio
7,814,567 B2 * 10/2010 Dovner et al. ..... 2/2.5
7,979,917 B2 * 7/2011 Osborne ..... 2/2.5
2002/0120973 A1 9/2002 D'annunzio
2004/0221361 A1 11/2004 D'annunzio
2010/0205708 A1 * 8/2010 Storms et al. ..... 2/2.5
2010/0235957 A1 * 9/2010 Dovner et al. ..... 2/2.5
2011/0113520 A1 * 5/2011 Dennis ..... 2/2.5

OTHER PUBLICATIONS

U.S. Appl. No. 11/507,635, Dovner.

* cited by examiner

*Primary Examiner* — Khoa Huynh
*Assistant Examiner* — Anna Kinsaul
(74) *Attorney, Agent, or Firm* — Greenberg Traurig, LLP

(57) ABSTRACT

In some embodiments, the instant invention provides a ballistic garment that at least includes: a front portion; a rear portion; a first releasable shackle attached to a front portion at a waist area of a front portion, wherein the first releasable shackle is configured to releasably clasp a ring of a left-shoulder strap and a ring of a left-waist strap; a second releasable shackle attached to the front portion at the waist area of the front portion, wherein the second releasable shackle is configured to releasably clasp a ring of a right-shoulder strap and a ring of the right-waist strap; and a pull mechanism operatively connected to each of the first and second releasable shackles to essentially simultaneously release all four rings.

13 Claims, 10 Drawing Sheets

PROTECTIVE GARMENTS HAVING QUICK RELEASE SYSTEMS AND ASSOCIATED METHODS

RELATED APPLICATIONS

This application claims the benefit of U.S. Provisional Application Ser. No. 60/891,065, filed Feb. 22, 2007. The aforementioned application is incorporated herein by reference in its entirety.

FIELD OF THE INVENTION

Various embodiments of the present invention relate to garments (e.g., outer garments) having quick release systems. Other embodiments relate to corresponding methods.

For the purposes of describing and claiming the present invention the term "ballistic" (e.g., "ballistic garment") is intended to refer to being resistant (but not necessarily impenetrable) to projectiles (e.g., handgun and/or rifle bullets), stab threats (e.g., knives), shrapnel (e.g., from IED's) and/or blunt threats (e.g., clubs).

BACKGROUND OF THE INVENTION

Oftentimes, such as in emergency situations, protective garments (e.g., soft body armor vests, hard body armor vests, safety vests, and other protective outer garments) need to be removed quickly. For example, when a soldier or law enforcement officer is wearing a protective vest and is injured or incapacitated, in order to provide immediate medical attention, the protective vest typically needs to be removed as quickly as possible. Similarly, a soldier in danger of drowning from being weighed down by protective outer garments along with the equipment and ammunition thereon, may save himself by quickly removing his protective outer garments. A protective garment may also need to be removed quickly, simply so the wearer may quickly change gear and put on other protective outer garments.

Figure 1:
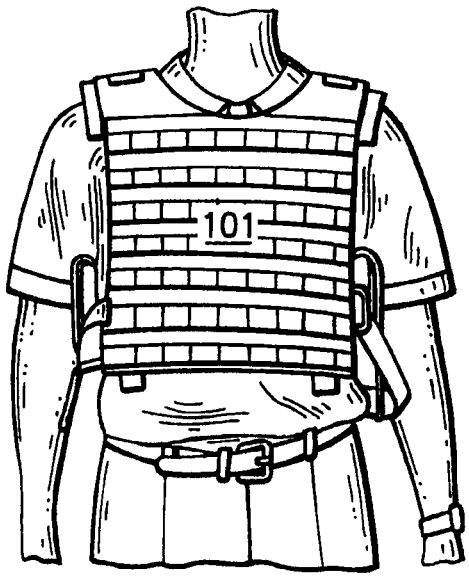
FIG. 1 shows a front view of a protective garment (as worn by a user) equipped with a quick release mechanism according to an embodiment of the present invention.

Among those benefits and improvements that have been disclosed, other objects and advantages of this invention will become apparent from the following description taken in conjunction with the accompanying figures. The figures constitute a part of this specification and include illustrative embodiments of the present invention and illustrate various objects and features thereof.

DETAILED DESCRIPTION OF THE INVENTION

Detailed embodiments of the present invention are disclosed herein; however, it is to be understood that the disclosed embodiments are merely illustrative of the invention that may be embodied in various forms. In addition, each of the examples given in connection with the various embodiments of the invention are intended to be illustrative, and not restrictive. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

One embodiment of the present invention provides a protective garment, such as a tactical ballistic vest, having a quick release system for separating the protective garment into a number of components, for instance, a front portion and back portion. In one example, the front and back portions of the vest may separate at the shoulders and at the sides of the waist. The front and back portions may be held together, for example, by four connectors (one for each shoulder and one for each side of the waist) releasably attached to two shackles disposed at a front waist area of the garment. A single pull mechanism may open both shackles to essentially simultaneously release both shoulders and both sides.

In one example, the tactical ballistic vest may be a solid front, side-entry style vest with adjustable shoulders and adjustable side closures. The tactical ballistic vest may contain, for example, IIIA soft armor and front, back, and side torso rifle plate protection that can be inserted or removed at will. The size of the rifle plates may vary, but may include (but not be limited to) 6×8, 7×8, 8×10, 10×12, and other Small Arms Protective Insert (SAPI) sizes. The tactical ballistic vest may also accept Department of Defense (DoD) Outer Tactical Vest (OTV) ballistic panels and enhanced protection components.

Further, the tactical ballistic vest may also accept, in an embodiment, standard military OTV additional ballistic options including (but not limited to) groin guard, neck and throat armor, shoulder and bicep protection. Full shoulder and chest friction material can also be provided for improved weapon welds and firing positions. The tactical ballistic vest may provide substantial load-bearing for Modular Lightweight Load-carrying Equipment (MOLLE), Pocket Attachment Ladder System (PALS), and Advanced Tactical (AT) style pouches and gear options. Additional features that may be provided, in an embodiment, include (but are not limited to) communication wire-routing channels, camelback hydration compatibility, and back drag strap. The tactical ballistic vest may also be integrated with military pack assemblies, and may be treated to be flame-resistant.

Figure 2:
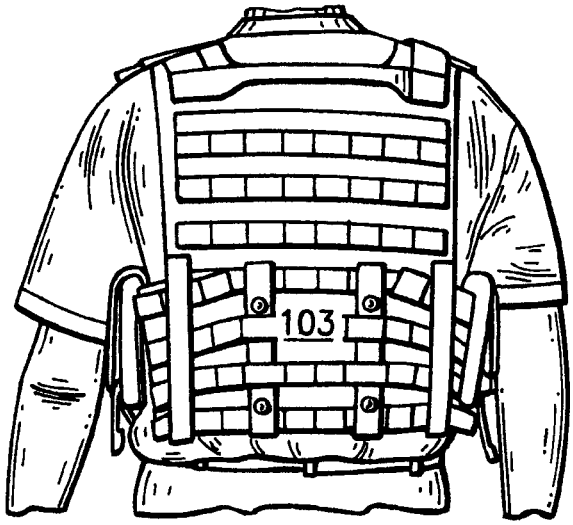
FIG. 2 shows a back view of the protective garment of FIG. 1.
Figure 3:
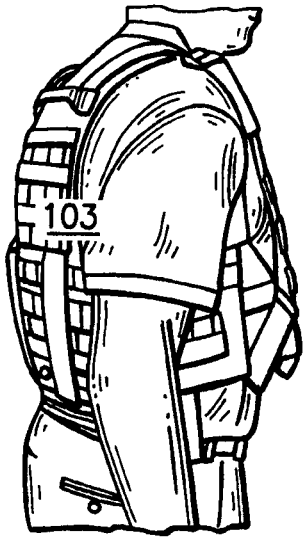
FIG. 3 shows a side view of the protective garment of FIG. 1.
Figure 4:
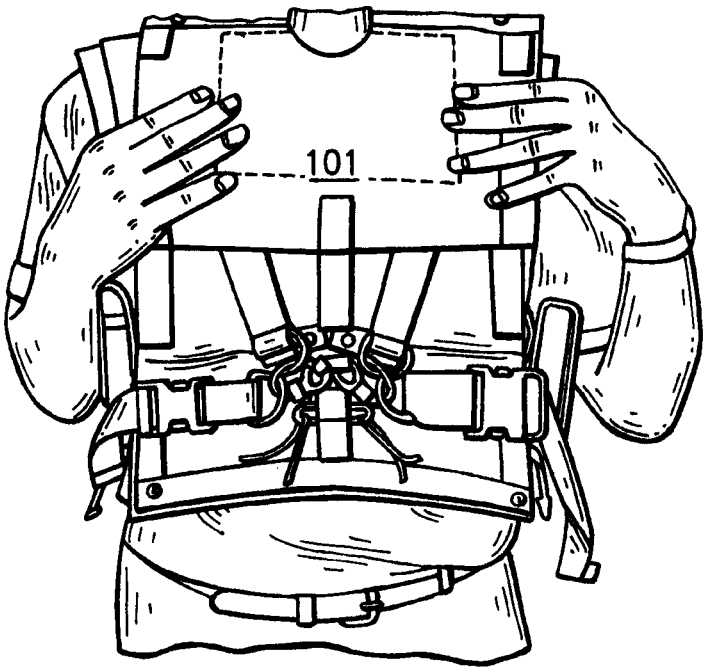
FIG. 4 shows another front view of the protective garment of FIG. 1 (with an outer flap raised and the quick release mechanism exposed).
Figure 5:
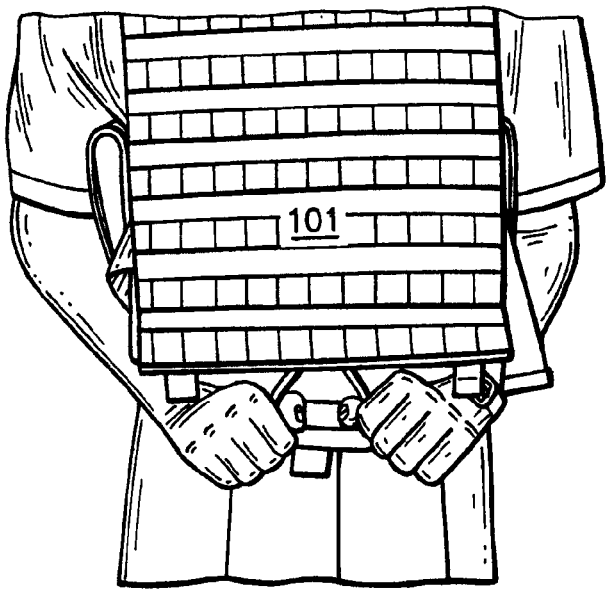
FIG. 5 shows a user pulling down on a release strap to open the quick release mechanism shown in FIG. 4.
Figure 6:
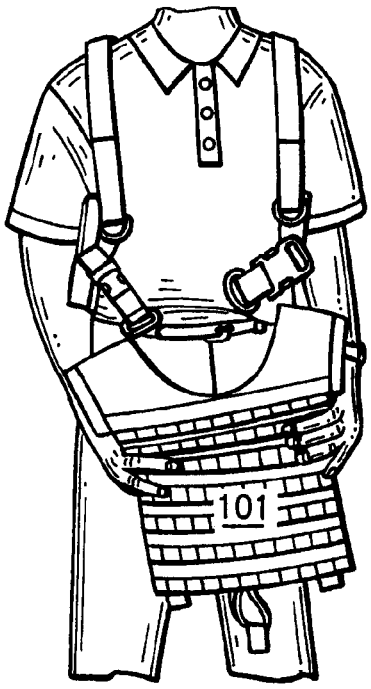
FIG. 6 shows separation of the front and back portions of the protective garment of FIG. 1 after opening of the quick release mechanism.
Figure 7:
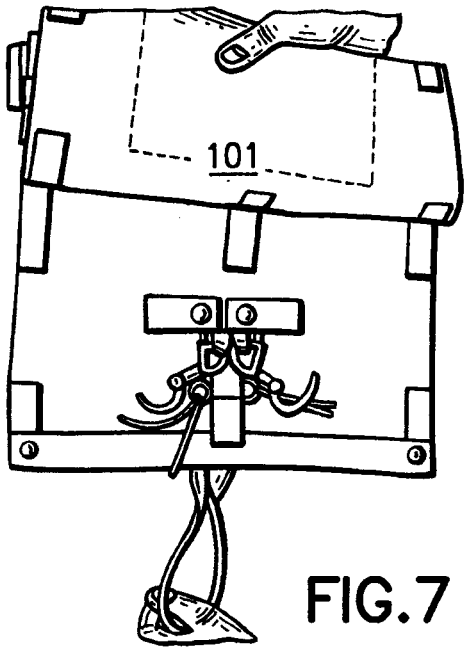
FIG. 7 shows another front view of the protective garment of FIG. 1 (with the outer flap raised and the quick release mechanism exposed).
Figure 8:
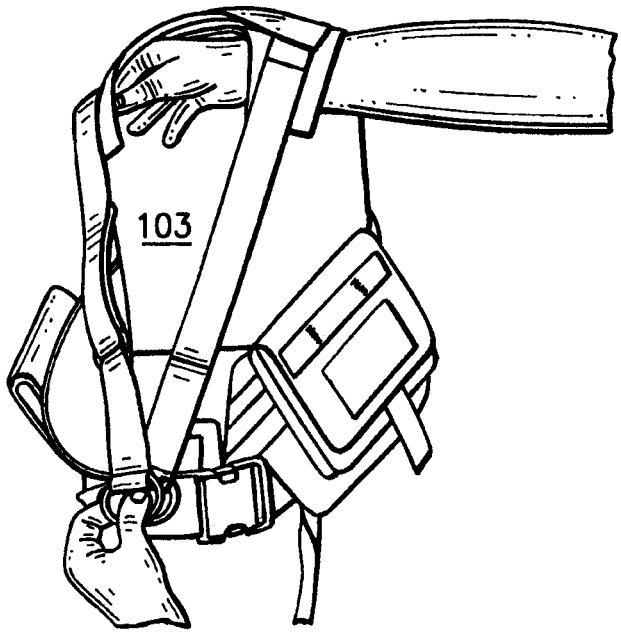
FIG. 8 shows straps extending from the shoulders and sides of the back portion of the protective garment of FIG. 1 (the straps are releasably attached at their free ends via rings or the like to the shackles of the quick release mechanism).

Referring now to the Figs., it is seen that FIG. 1 shows a front view of a protective garment (as worn by a user) equipped with a quick release mechanism according to an embodiment of the present invention (a front portion of the garment is indicated in the figures by call-out number 101); FIG. 2 shows a back view of the protective garment of FIG. 1 (a back portion of the garment is indicated in the figures by call-out number 103); FIG. 3 shows a side view of the protective garment of FIG. 1; FIG. 4 shows another front view of the protective garment of FIG. 1 (with an outer flap raised and the quick release mechanism exposed); FIG. 5 shows a user pulling down on a release strap to open the quick release mechanism shown in FIG. 4; FIG. 6 shows separation of the front and back portions of the protective garment of FIG. 1 after opening of the quick release mechanism; FIG. 7 shows another front view of the protective garment of FIG. 1 (with the outer flap raised and the quick release mechanism exposed); and FIG. 8 shows straps extending from the shoulders and sides of the back portion of the protective garment of FIG. 1 (the straps are releasably attached at their free ends via rings or the like to the shackles of the quick release mechanism).

With particular note to FIGS. 4-8, it is seen that in one embodiment of the present invention the two shoulder straps from the back portion 103 of the garment and the two side straps from the waist-area sides of the back portion 103 of the garment may be releasably attached to the two shackles on the front portion 101 of the garment. A single pull mechanism may open both shackles to essentially simultaneously release both shoulders and both sides.

Figure 9:
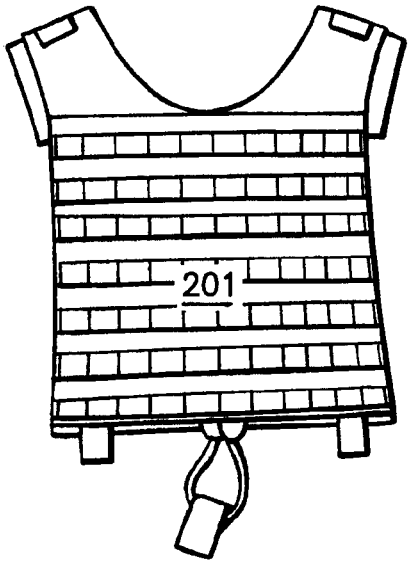
FIG. 9 shows a front view of a front portion of a protective garment equipped with a quick release mechanism according to another embodiment of the present invention.
Figure 10:
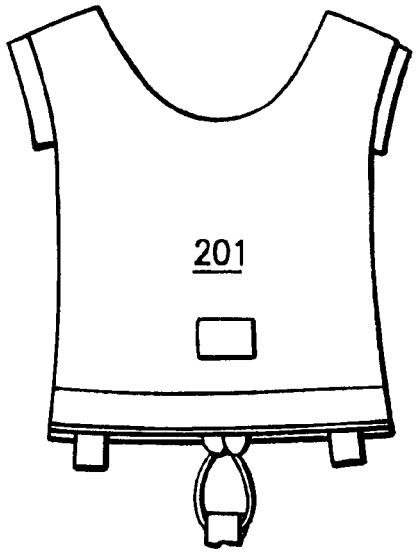
FIG. 10 shows an inside of the front portion of the protective garment of FIG. 9.
Figure 11:
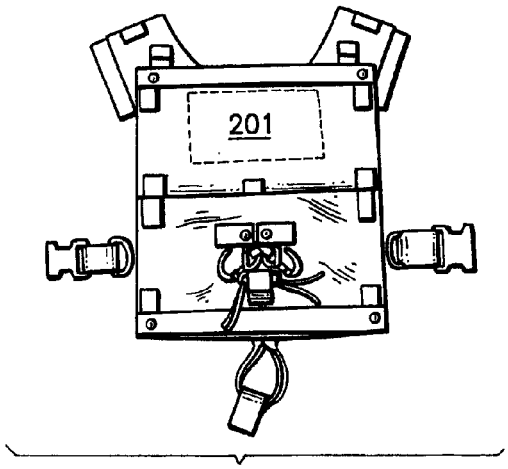
FIGS. 11-14 show other front views of the protective garment of FIG. 9 (with an outer flap raised and the quick release mechanism exposed).
Figure 12:
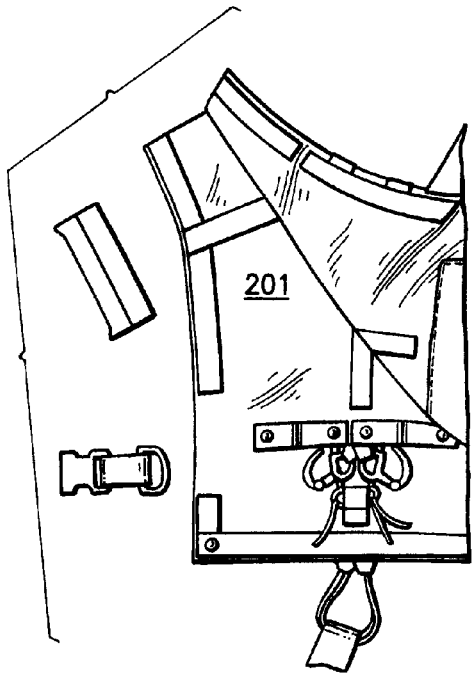
Figure 13:
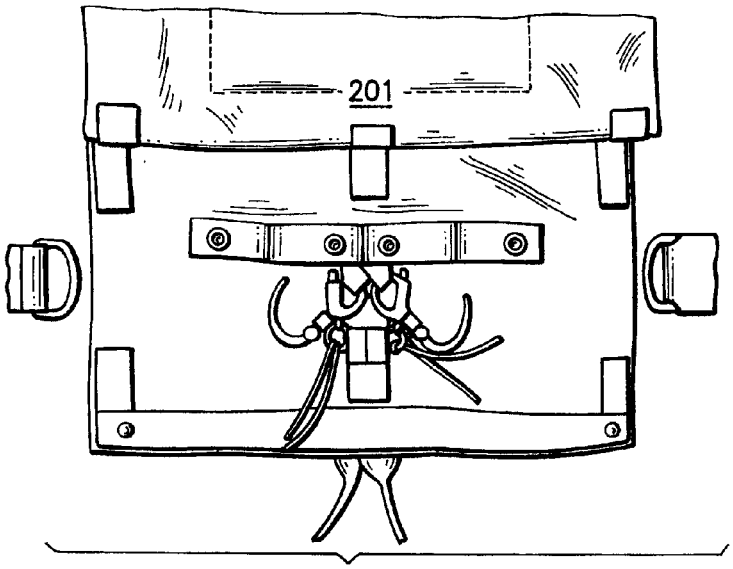
Figure 14:
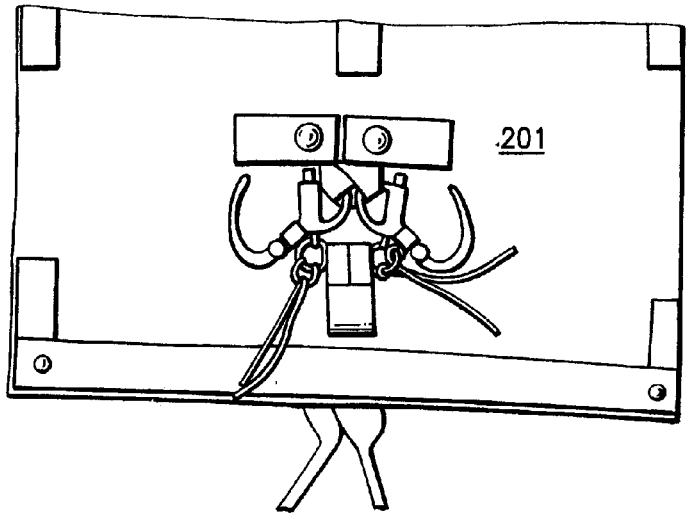
Figure 15:
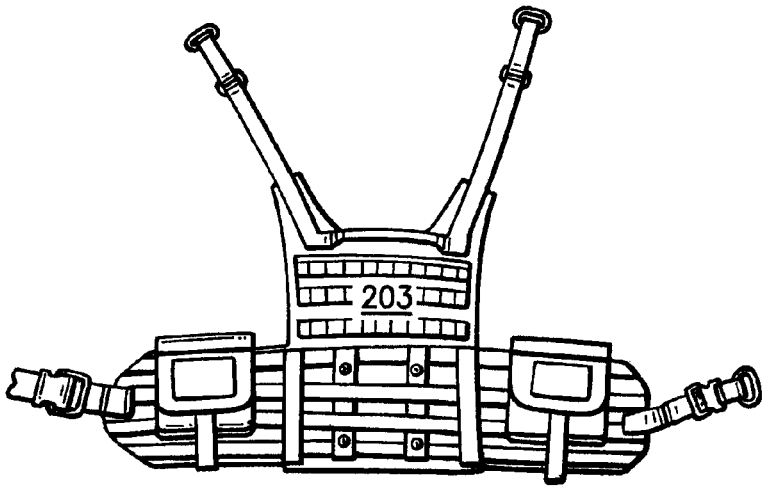
FIGS. 15-16 show back views of the protective garment of FIG. 9.
Figure 16:
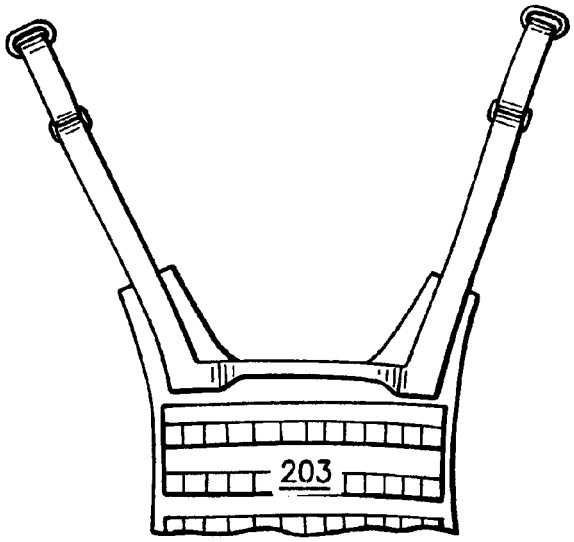
Figure 17:
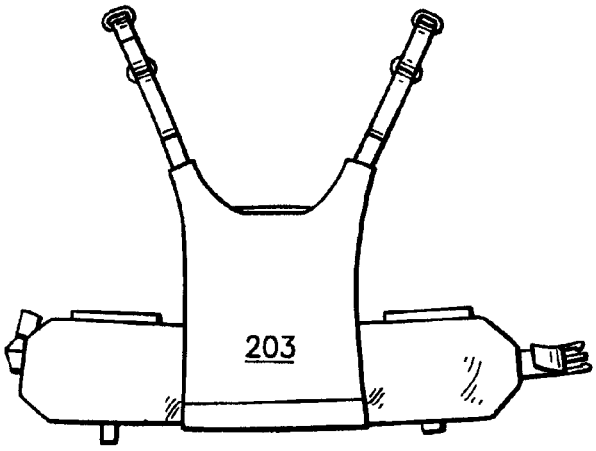
FIGS. 17-18 show views of the inside of the back portion of the protective garment of FIG. 9.
Figure 18:
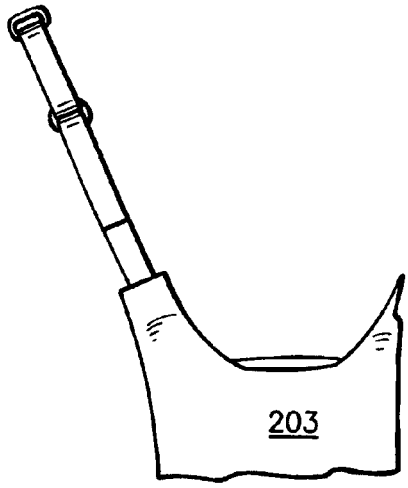
Figure 19:
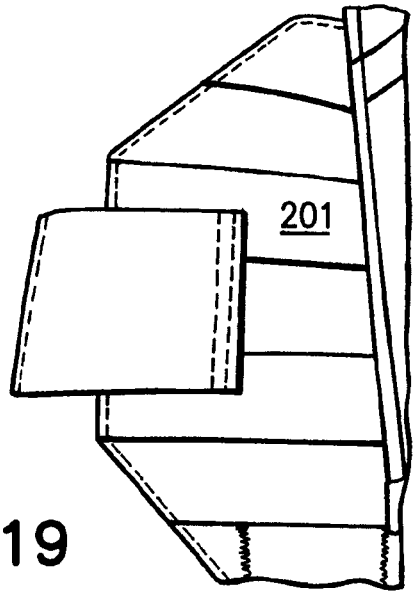
FIGS. 19-20 show views of side adjustment straps of the protective garment of FIG. 9.
Figure 20:
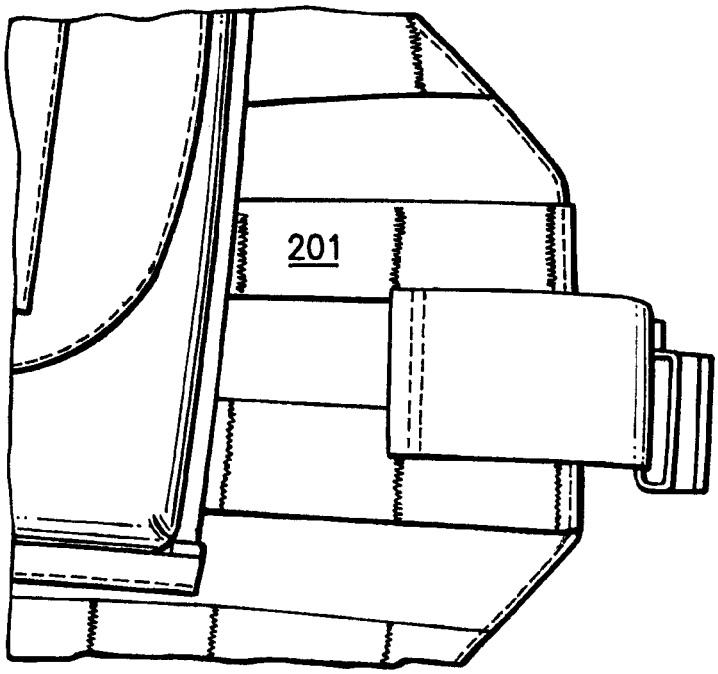

Referring now to FIGS. 9-20, it is seen that FIG. 9 shows a view of a front portion 201 of a protective garment equipped with a quick release mechanism according to another embodiment of the present invention (this Fig. shows the flip-up front with "slip-not" on the shoulders; PALS webbing on top edge of shoulders; PALS webbing on full front with 2 rows of loop at top; bolsters (e.g., to stop rifle butt from sliding) are removable (e.g., via hook & loop on edge to attach to inside of front); FIG. 10 shows an inside of the front portion 201 of the protective garment of FIG. 9; FIGS. 11-14 show other front views of the protective garment of FIG. 9 (with an outer flap raised and the quick release mechanism exposed—of note, it is seen that the side straps may comprise multi-part elements (see, e.g., FIGS. 11-13)); FIGS. 15-16 show back views of the protective garment of FIG. 9 (FIG. 15 shows back of vest with side panels having 4 rows of PALS webbing; "man down" strap; a 1.5" buckle on one side and a 2" buckle on the other side; the shoulder strap is doubled webbing & longer along with the fold/flip going to the inside so the strap slips through the web loop on the front easier—FIG. 16 may be modified by adding more length to the shoulder straps and the straps may go down under/behind the 2 rows of loop on the back of the vest); FIGS. 17-18 show views of the inside of the back portion 203 of the protective garment of FIG. 9; and FIGS. 19-20 show views of side adjustment straps of the protective garment of FIG. 9 (FIG. 19 shows recessed side strap so the end of the mitered panel can tuck under the front for a better fit; and FIG. 20 shows a 1.5" wide adjustment strap for shackles.

With particular note to FIGS. 9-14, it is seen again that in one embodiment of the present invention the two shoulder straps from the back portion 203 of the garment and the two side straps from the waist-area sides of the back portion 203 of the garment may be releasably attached to the two shackles on the front portion 201 of the garment. A single pull mechanism may open both shackles to essentially simultaneously release both shoulders and both sides. In another example, the front portion 201 and/or the back portion 203 may be made of natural and/or synthetic material, e.g., leather, nylon, kevlar, etc. One or both portions 201,203 may include internal pockets for holding the rifle plates discussed above. The pockets may be located in torso portions and/or side portions. The pockets may be accessed from external openings and/or from inside the tactical ballistic vest.

In another example, each ring or the like may be attached to a respective strap by stitching, gluing, or fastening. It should be appreciated that other types of clasps, clamps, fasteners, and snap shackles may be substituted for those shown herein.

In another example, each ring may comprise: a D-ring, O-ring, oval-ring, or a loop. Similarly, although the releasable shackles may be depicted as snap shackles, other designs including clasps or other fasteners can readily be used and not deviate from the teachings of the present invention. Further, each releasable shackle may comprise a release knob, for moving the shackle into an open position. The release knob may be spring loaded to permit actuation of the releasable shackle into an open position upon pulling of the knob (and then providing automatic closure).

In another example, each of the two releasable shackles described herein may be individually opened (e.g., by a back-up string or cord). In one example (wherein the left shoulder and left waist are releasably attached to one shackle and the right shoulder and right waist are releasably attached to the other shackle), this individual opening may permit one side of the garment or the other (e.g., the left side or the right side) to be individually opened at the shoulder and waist. In another example (wherein the left and right shoulders are releasably attached to one shackle and the left and right waists are releasably attached to the other shackle), this individual opening may permit the top or bottom of the garment to be individually opened at the shoulders or at the waist.

In another embodiment a ballistic garment configured to be worn by a user is provided, comprising: a front portion; a back portion; a left-shoulder strap, wherein the left-shoulder strap is attached at a first end to the back portion, wherein the left-shoulder strap is configured to be draped over the left shoulder of the user, and wherein a free end of the left-shoulder strap has a ring attached thereto; a right-shoulder strap, wherein the right-shoulder strap is attached at a first end to the back portion, wherein the right-shoulder strap is configured to be draped over the right shoulder of the user, and wherein a free end of the right-shoulder strap has a ring attached thereto; a left-waist strap, wherein the left-waist strap is attached at a first end to the back portion, wherein the left-waist strap is configured to wrap around the left waist area of the user, and wherein a free end of the left-waist strap has a ring attached thereto; a right-waist strap, wherein the right-waist strap is attached at a first end to the back portion, wherein the right-waist strap is configured to wrap around the right waist area of the user, and wherein a free end of the right-waist strap has a ring attached thereto; a first releasable shackle attached to the front portion at a waist area of the front portion, wherein the first releasable shackle is configured to releasably clasp the ring of the left-shoulder strap and the ring of the left-waist strap; a second releasable shackle attached to the front portion at a waist area of the front portion, wherein the second releasable shackle is configured to releasably clasp the ring of the right-shoulder strap and the ring of the right-waist strap; and a pull mechanism operatively connected to each of the first and second releasable shackles to essentially simultaneously release all four rings.

In one example, the front portion may be releasably held to the back portion by the clasping of the ring of the left-shoulder strap and the ring of the left-waist strap by the first releasable shackle and by the clasping of the ring of the right-shoulder strap and the ring of the right-waist strap by the second releasable shackle.

In another example, the essentially simultaneous release of all four rings may essentially simultaneously release the front portion from the back portion at both shoulders of the user and at the waist of the user.

In another example, the pull mechanism may comprise a pull cord.

In another example, the pull mechanism may comprise a single pull cord.

In another example, each of the plurality of rings may comprise at least one of: a D-ring, an O-ring, and a loop.

In another example, the garment may comprise at least one of: (a) a soft body armor vest; and (b) a hard body armor vest.

In another example, each of the first releasable shackle and the second releasable shackle may be configured to be capable of being opened independently from one another.

In another example, the opening of the first releasable shackle may release the ring of the left-shoulder strap and the ring of the left-waist strap to allow a left side of the front portion to separate from a left side of the back portion while leaving the front portion and the back portion attached at a right side of the ballistic garment.

In another example, the opening of the second releasable shackle may release the ring of the right-shoulder strap and the ring of the right-waist strap to allow a right side of the front portion to separate from a right side of the back portion while leaving the front portion and the back portion attached at a left side of the ballistic garment.

In another example, the garment may further comprise a plurality of back-up cords, wherein each of the plurality of back-up cords is attached to a corresponding one of the releasable shackles, each of the plurality of back-up cords being capable of disengaging a corresponding one of the plurality of releasable shackles from corresponding ones of the plurality of rings without use of the pull mechanism.

In another embodiment a ballistic garment configured to be worn by a user is provided, comprising: a front portion; a back portion; a left-shoulder strap, wherein the left-shoulder strap is attached at a first end to the back portion, wherein the left-shoulder strap is configured to be draped over the left shoulder of the user, and wherein a free end of the left-shoulder strap has a ring attached thereto; a right-shoulder strap, wherein the right-shoulder strap is attached at a first end to the back portion, wherein the right-shoulder strap is configured to be draped over the right shoulder of the user, and wherein a free end of the right-shoulder strap has a ring attached thereto; a left-waist strap, wherein the left-waist strap is attached at a first end to the back portion, wherein the left-waist strap is configured to wrap around the left waist area of the user, and wherein a free end of the left-waist strap has a ring attached thereto; a right-waist strap, wherein the right-waist strap is attached at a first end to the back portion, wherein the right-waist strap is configured to wrap around the right waist area of the user, and wherein a free end of the right-waist strap has a ring attached thereto; at least one releasable shackle, wherein the releasable shackle is configured to releasably clasp the ring of the left-shoulder strap, the ring of the left-waist strap; the ring of the right-shoulder strap and the ring of the right-waist strap; and a pull mechanism operatively connected to the releasable shackle to essentially simultaneously release all four rings.

In another example, the releasable shackle(s) may be located on the front portion of the ballistic garment.

In another example, the releasable shackle(s) may be located on the back portion of the ballistic garment.

In another example, the essentially simultaneous release of all four rings may essentially simultaneously release the front portion from the back portion at both shoulders of the user and at the waist of the user.

In another example, the pull mechanism may comprise a pull cord.

In another example, the pull mechanism may comprise a single pull cord.

In another example, each of the plurality of rings may comprise at least one of: a D-ring, an O-ring, and a loop.

In another example, the garment may comprise at least one of: (a) a soft body armor vest; and (b) a hard body armor vest.

In another embodiment, a method for removing a ballistic garment is provided, the method comprising: wearing a ballistic garment having: (a) a front portion; (b) a back portion; (c) a left-shoulder strap, wherein the left-shoulder strap is attached at a first end to the back portion, wherein the left-shoulder strap is configured to be draped over the left shoulder of the user, and wherein a free end of the left-shoulder strap has a ring attached thereto; (d) a right-shoulder strap, wherein the right-shoulder strap is attached at a first end to the back portion, wherein the right-shoulder strap is configured to be draped over the right shoulder of the user, and wherein a free end of the right-shoulder strap has a ring attached thereto; (e) a left-waist strap, wherein the left-waist strap is attached at a first end to the back portion, wherein the left-waist strap is configured to wrap around the left waist area of the user, and wherein a free end of the left-waist strap has a ring attached thereto; (f) a right-waist strap, wherein the right-waist strap is attached at a first end to the back portion, wherein the right-waist strap is configured to wrap around the right waist area of the user, and wherein a free end of the right-waist strap has a ring attached thereto; (g) a first releasable shackle attached to the front portion at a waist area of the front portion, wherein the first releasable shackle is configured to releasably clasp the ring of the left-shoulder strap and the ring of the left-waist strap; and (h) a second releasable shackle attached to the front portion at a waist area of the front portion, wherein the second releasable shackle is configured to releasably clasp the ring of the right-shoulder strap and the ring of the right-waist strap; and pulling a pull mechanism operatively connected to each of the first and second releasable shackles to essentially simultaneously release all four rings.

In another embodiment a method for assembling a ballistic garment is provided, the method comprising: providing a ballistic garment having: (a) a front portion; (b) a back portion; (c) a left-shoulder strap, wherein the left-shoulder strap is attached at a first end to the back portion, wherein the left-shoulder strap is configured to be draped over the left shoulder of the user, and wherein a free end of the left-shoulder strap has a ring attached thereto; (d) a right-shoulder strap, wherein the right-shoulder strap is attached at a first end to the back portion, wherein the right-shoulder strap is configured to be draped over the right shoulder of the user, and wherein a free end of the right-shoulder strap has a ring attached thereto; (e) a left-waist strap, wherein the left-waist strap is attached at a first end to the back portion, wherein the left-waist strap is configured to wrap around the left waist area of the user, and wherein a free end of the left-waist strap has a ring attached thereto; (f) a right-waist strap, wherein the right-waist strap is attached at a first end to the back portion, wherein the right-waist strap is configured to wrap around the right waist area of the user, and wherein a free end of the right-waist strap has a ring attached thereto; (g) a first releasable shackle attached to the front portion at a waist area of the front portion, wherein the first releasable shackle is configured to releasably clasp the ring of the left-shoulder strap and the ring of the left-waist strap; and (h) a second releasable shackle attached to the front portion at a waist area of the front portion, wherein the second releasable shackle is configured to releasably clasp the ring of the right-shoulder strap and the ring of the right-waist strap; attaching the first releasable shackle through the ring of the left-shoulder strap and the ring of the left-waist strap to secure a left side of the front portion to a left side of the back portion; and attaching the second releasable shackle through the ring of the right-shoulder strap and the ring of the right-waist strap to secure a right side of the front portion to a right side of the back portion.

While a number of embodiments of the present invention have been described, it is understood that these embodiments are illustrative only, and not restrictive, and that many modifications may become apparent to those of ordinary skill in the art. For example, while the embodiments of the present invention discussed in this application are primarily focused on tactical ballistic vests, body armor vests, and other protective vests, those skilled in the art will appreciate that the quick release system of the present invention can also be configured and utilized on other garments including (but not limited to) safety vests, life preservers, harnesses, parachutes, military packs, and backpacks. Further, the protective garment may include one or more flame resistant elements (e.g., a flame resistant lining). Further still, any desired number of releasable shackles and/or straps/rings may be utilized. Further still, all sizes, measurements and the like are intended to be illustrative, and not restrictive. Further still, various methods corresponding to various systems disclosed herein are contemplated and the various steps may be carried out in any desired order (and any desired steps may be added and/or any desired steps may be eliminated).

What is claimed is:

1. A ballistic garment configured to be worn by a user, comprising:

a front portion;

a rear portion;

a left-shoulder strap, wherein the left-shoulder strap is attached at a first end to the rear portion, wherein the left-shoulder strap is configured to be draped over the left shoulder of the user, and wherein a free end of the left-shoulder strap has a ring attached thereto;

a right-shoulder strap, wherein the right-shoulder strap is attached at a first end to the rear portion, wherein the right-shoulder strap is configured to be draped over the right shoulder of the user, and wherein a free end of the right-shoulder strap has a ring attached thereto;

a left-waist strap, wherein the left-waist strap is attached at a first end to the rear portion, wherein the left-waist strap is configured to wrap around the left waist area of the user, and wherein a free end of the left-waist strap has a ring attached thereto;

a right-waist strap, wherein the right-waist strap is attached at a first end to the rear portion, wherein the right-waist strap is configured to wrap around the right waist area of the user, and wherein a free end of the right-waist strap has a ring attached thereto;

a first releasable shackle attached to the front portion at a waist area of the front portion, wherein the first releasable shackle is configured to releasably clasp the ring of the left-shoulder strap and the ring of the left-waist strap;

a second releasable shackle attached to the front portion at the waist area of the front portion, wherein the second releasable shackle is configured to releasably clasp the ring of the right-shoulder strap and the ring of the right-waist strap; and a pull mechanism operatively connected to each of the first and second releasable shackles to essentially simultaneously release all four rings.

2. The garment of claim 1, wherein the front portion is releasably held to the rear portion by the clasping of the ring of the left-shoulder strap and the ring of the left-waist strap by the first releasable shackle and by the clasping of the ring of the right-shoulder strap and the ring of the right-waist strap by the second releasable shackle.

3. The garment of claim 1, wherein the essentially simultaneous release of all four rings essentially simultaneously releases the front portion from the rear portion at both shoulders of the user and at the waist of the user.

4. The garment of claim 1, wherein the pull mechanism comprises a pull cord.

5. The garment of claim 4, wherein the pull mechanism comprises a single pull cord.

6. The garment of claim 1, wherein each of the plurality of rings comprises at least one of: a D-ring, an O-ring, and a loop.

7. The garment of claim 1, wherein the garment comprises at least one of: (a) a soft body armor vest; and (b) a hard body armor vest.

8. The garment of claim 1, wherein each of the first releasable shackle and the second releasable shackle is configured to be capable of being opened independently from one another.

9. The garment of claim 8, wherein opening of the first releasable shackle releases the ring of the left-shoulder strap and the ring of the left-waist strap to allow a left side of the front portion to separate from a left side of the rear portion while leaving the front portion and the rear portion attached at a right side of the ballistic garment.

10. The garment of claim 8, wherein opening of the second releasable shackle releases the ring of the right-shoulder strap and the ring of the right-waist strap to allow a right side of the front portion to separate from a right side of the rear portion while leaving the front portion and the rear portion attached at a left side of the ballistic garment.

11. The garment of claim 1, further comprising a plurality of back-up cords, wherein each of the plurality of back-up cords is attached to a corresponding one of the releasable shackles, each of the plurality of back-up cords being capable of disengaging a corresponding one of the plurality of releasable shackles from corresponding ones of the plurality of rings without use of the pull mechanism.

12. A method for removing a ballistic garment, the method comprising:

wearing a ballistic garment having: (a) a front portion; (b) a rear portion; (c) a left-shoulder strap, wherein the left-shoulder strap is attached at a first end to the rear portion, wherein the left-shoulder strap is configured to be draped over the left shoulder of the user, and wherein a free end of the left-shoulder strap has a ring attached thereto; (d) a right-shoulder strap, wherein the right-shoulder strap is attached at a first end to the rear portion, wherein the right-shoulder strap is configured to be draped over the right shoulder of the user, and wherein a free end of the right-shoulder strap has a ring attached thereto; (e) a left-waist strap, wherein the left-waist strap is attached at a first end to the rear portion, wherein the left-waist strap is configured to wrap around the left waist area of the user, and wherein a free end of the left-waist strap has a ring attached thereto; (f) a right-waist strap, wherein the right-waist strap is attached at a first end to the rear portion, wherein the right-waist strap is configured to wrap around the right waist area of the user, and wherein a free end of the right-waist strap has a ring attached thereto; (g) a first releasable shackle attached to the front portion at a waist area of the front portion, wherein the first releasable shackle is configured to releasably clasp the ring of the left-shoulder strap and the ring of the left-waist strap; and (h) a second releasable shackle attached to the front portion at the waist area of the front portion, wherein the second releasable shackle is configured to releasably clasp the ring of the right-shoulder strap and the ring of the right-waist strap; and pulling a pull mechanism operatively connected to each of the first and second releasable shackles to essentially simultaneously release all four rings.

13. A method for assembling a ballistic garment, the method comprising:

providing a ballistic garment having: (a) a front portion; (b) a rear portion; (c) a left-shoulder strap, wherein the left-shoulder strap is attached at a first end to the rear portion, wherein the left-shoulder strap is configured to be draped over the left shoulder of the user, and wherein a free end of the left-shoulder strap has a ring attached thereto; (d) a right-shoulder strap, wherein the right-shoulder strap is attached at a first end to the rear portion, wherein the right-shoulder strap is configured to be draped over the right shoulder of the user, and wherein a free end of the right-shoulder strap has a ring attached thereto; (e) a left-waist strap, wherein the left-waist strap is attached at a first end to the rear portion, wherein the left-waist strap is configured to wrap around the left waist area of the user, and wherein a free end of the left-waist strap has a ring attached thereto; (f) a right-waist strap, wherein the right-waist strap is attached at a first end to the rear portion, wherein the right-waist strap is configured to wrap around the right waist area of the user, and wherein a free end of the right-waist strap has a ring attached thereto; (g) a first releasable shackle attached to the front portion at a waist area of the front portion, wherein the first releasable shackle is configured to releasably clasp the ring of the left-shoulder strap and the ring of the left-waist strap; and (h) a second releasable shackle attached to the front portion at the waist area of the front portion, wherein the second releasable shackle is configured to releasably clasp the ring of the right-shoulder strap and the ring of the right-waist strap;

attaching the first releasable shackle through the ring of the left-shoulder strap and the ring of the left-waist strap to secure a left side of the front portion to a left side of the rear portion; and attaching the second releasable shackle through the ring of the right-shoulder strap and the ring of the right-waist strap to secure a right side of the front portion to a right side of the rear portion.

* * * * *